United States Patent [19]

Wurm

[11] Patent Number: 4,682,434

[45] Date of Patent: Jul. 28, 1987

[54] FLINTLOCK IGNITION MECHANISM

[76] Inventor: Thomas J. Wurm, 1041 Winchell Rd., Aurora, Ohio 44202

[21] Appl. No.: 893,982

[22] Filed: Aug. 7, 1986

[51] Int. Cl.[4] ..... F41C 27/00

[52] U.S. Cl. ..... 42/51; 42/69.01

[58] Field of Search ..... 42/51, 83, 69.01

[56] References Cited

U.S. PATENT DOCUMENTS 3,247,611 4/1966 Wilson ..... 42/51

3,744,169 7/1973 Straight ..... 42/51

4,422,255 12/1983 Lapp ..... 42/51

4,471,550 9/1984 Kyper ..... 42/51

*Primary Examiner*—Charles T. Jordan

*Attorney, Agent, or Firm*—Pearne, Gordon, McCoy & Granger

[57] ABSTRACT

A flintlock mechanism for a firearm is modified to utilize a pyrophoric element to produce the sparks necessary for ignition. The pyrophoric element is mounted on the frizzen surface normally struck by the flint whereby the flint strikes the pyrophoric element to abrade particles which are thereby ignited and driven into the priming charge in the pan.

11 Claims, 4 Drawing Figures

FLINTLOCK IGNITION MECHANISM

BACKGROUND OF THE INVENTION

This invention relates to flintlock ignition mechanisms for firearms, such as rifles, pistols, and shotguns, and more particularly to an arrangement for easily converting a conventional flintlock mechanism to use pyrophoric metals to produce a more intense spark for more positive ignition by a simple alteration which allows the mechanism to be easily reconverted to a conventional flintlock system.

A conventional flintlock mechanism is attached to a wooden stock which also serves to mount the barrel and is positioned adjacent the barrel breech. The mechanism includes a lockplate on which is pivotally mounted a hammer biased by a mainspring toward a downward position and held against the spring force by a sear mechanism that can be released by a trigger which may be separately mounted on the stock.

The hammer carries a flint which is gripped between fixed and movable jaws mounted on the hammer. Also located on the lockplate is a pan open on the upper side and adapted to receive a priming charge which, when ignited, will communicate the flame through a touch hole in the barrel breech to the main charge within the barrel. A combination cover and frizzen is mounted pivotally in front of the pan on the lockplate, so that when the hammer is in the cocked position, the cover closes off the upper side of the pan to protect and retain the charge therein while the frizzen extends in a generally upward direction. When the hammer is released, the flint strikes the surface of the frizzen and, by the engagement between the flint and the steel, creates sparks of incandescently hot iron which are directed in a downward direction toward the pan. As the flint strikes the frizzen, the frizzen and cover are lifted upwardly to expose the pan so that the sparks go into the pan to ignite the priming charge.

With the conventional flintlock mechanism, it is important for proper ignition that the flint be properly knapped or shaped and the frizzen clean and dry to ensure production of sufficient sparks for ignition. It has been recognized that the combination of flint and steel, while functioning adequately under ideal conditions, can deteriorate severely in performance by the presence of moisture or damage to the flint to produce a less than ideal shape for producing sparks. Thus, shooting enthusiasts who still enjoy the use of flintlock firearms have long sought improvements that would produce a better spark for faster and more reliable ignition of the priming charge.

It has also been recognized that one method of producing better sparks is to utilize a Misch metal pyrophoric alloy as has been used in cigarett lighters and the like for ignition of volatile liquid fuels. One early effort to utilize pyrophoric alloys is found in U.S. Pat. No. 3,247,611 issued Apr. 26, 1966. This patent discloses a mechanism utilizing a wheel, much like that of a cigarette lighter, which is embedded in the breech block and utilizes a cigarette lighter-type, pyrophoric flint spring-loaded against the wheel. Because this mechanism is enclosed, it will not function many times before cleaning is necessary because of the powder fouling which is forced into the mechanism under the high breech pressure when the firearm discharges.

A more successful effort is shown in U.S. Pat. No. 4,471,550, issued Sept. 18, 1984, which utilizes a more conventional flintlock mechanism. As shown in this patent, a small housing carrying a wheel and cigarette lighter pyrophoric flint is clamped on the hammer in the place of the conventional flint, and the frizzen is covered with a suitable friction material, such as leather. Thus, when the hammer falls, the flint wheel will engage the leather on the frizzen to rotate in the manner of a conventional cigarette lighter and abrade the pyrophoric flint to cause sparks to be directed downward into the pan as the frizzen and cover move away.

SUMMARY OF THE INVENTION

It is a principal object of the present invention to provide a simple and more effective arrangement for using a pyrophoric alloy in a flintlock mechanism to provide a hotter and more intense shower of sparks from the pyrophoric alloy to produce a more rapid and more reliable ignition of the priming charge in the pan.

It is also an object to provide such an arrangement for a pyrophoric alloy which involves minimum alteration of the flintlock mechanism from the conventional and allows easy restoration and functioning of the original mechanism in every detail.

According to the preferred embodiment of this invention, the flintlock mechanism may retain the original flint mounted on the hammer. The pyrophoric alloy element may take the form of one or more rods of material mounted on a backing surface, such as a heavy-duty pressure-sensitive plastic tape, which may be mounted, by reason of the pressure-sensitive adhesive, directly on the contacting surface of the frizzen. The element has a sufficient vertical length along the frizzen as to allow a relatively long contact area as the frizzen moves back to uncover the pan and as the hammer holding the flint continues on its downward path. The invention may, therefore, be easily applied to a conventional flintlock merely by taking the strip of material with the pyrophoric alloy on it, removing a backing strip from the tape, and then causing it to adhere directly on the frizzen. Likewise, the flintlock mechanism can be restored to its original mode of operation by merely peeling off the tape to uncover the original frizzen surface. It may or may not be necessary, depending upon its condition and position, to modify or reposition the flint on the hammer, but it is noted that rather than having a single sharp edge of the flint to strike the frizzen, with the present invention a more effective discharge of sparks is obtained by using a flint configuration having a more roughened surface having vertically spaced abrading portions to allow a greater abrasion of the pyrophoric alloy, which is necessarily much softer than the original frizzen surface. If it is so desired, it is possible to replace the flint entirely with a piece of hardened steel or similar material having a serrated surface positioned to make contact with the pyrophoric alloy.

It is also contemplated according to other embodiments of the invention to allow the pyrophoric alloy to be mounted in other ways, such as a resilient elastic sleeve which fits over the frizzen and elastically holds the pyrophoric alloy in place. It is possible that the pyrophoric alloy may consist of a plurality of vertically extending strips, and they may, in fact, be mounted on a harder backing material, such as thin sheet steel or the like, which may be attached to the frizzen by a suitable adhesive.

DETAILED DESCRIPTION OF THE INVENTION

Figure 1:
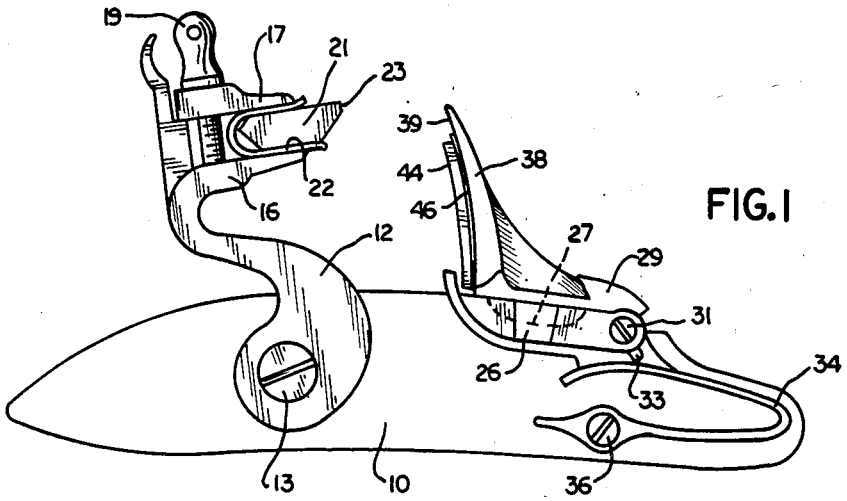
FIG. 1 is a side elevation of a flintlock mechanism, with the hammer in the cocked position, showing the preferred embodiment of the present invention as applied to the frizzen.

FIG. 1 shows a flintlock mechanism of the type that can be applied to a rifle, pistol, or shotgun, which is basically of the conventional, commercially available type adapted to be mounted on a wooden stock which also supports a barrel and separate trigger. The lock mechanism includes a lockplate 10 on which the various parts are mounted, and which is held in place in an inletted opening in the wooden stock by suitable means, such as screws (not shown). A hammer 12 is rotatably mounted on the rear portion of the lockplate by means of a pivot screw 13, and FIG. 1 shows the hammer 12 in the fully cocked position. It will be understood that in the conventional manner the hammer is biased to rotate in a clockwise direction by a suitable mainspring, and is held in place in the cocked position by a sear which can be released to allow the hammer 12 to rotate freely in a clockwise direction under the force of the mainspring. The hammer includes a fixed jaw portion 16 above which is mounted a movable jaw 17 which is moved by a clamp screw 19. A flint 21 is held between the jaws 16 and 17, and may be surrounded by a piece of leather 22 for better frictional gripping. The flint 21 may be conventionally shaped, or preferably may have a roughened leading edge 23, as shown and discussed in greater detail hereinafter.

A pan 26 is mounted on lockplate 10 forwardly of the hammer 12, and has a recess 27 formed on its upper surface to receive the priming charge. It will be understood that the recess 27 and the priming charge therein are in communication with a touch hole formed in the barrel breech, so that when the priming charge is ignited, the flame passes through the touch hole to the main charge in the barrel. A cover 29 is pivotally mounted by a screw 31 at the front end, so that in the closed position it extends across the pan 26 to close off the upper surface of the recess 27 to protect the priming charge and hold it in place when the gun is being handled. On its lower side, the cover 29 has a projecting horn 33 adapted to make contact with a leaf spring 34 held in place on the outer side of the lockplate 10 by a suitable mounting screw 36. The frizzen 38 is integral with the cover 29 and extends upwardly at the rear end of the cover, where it carries a curved striking surface 39 adapted to be engaged by the flint 21 when the hammer is released. The horn 33 functions with the leaf spring 34 to ensure that the cover and frizzen are biased in a closed position under one condition, and when the cover and frizzen are moved away, the force on the horn 33 is reversed and the cover is held in an open position.

The foregoing structure is that of a conventional flintlock mechanism. When the hammer is released from the cocked position and rotates forward, the edge 23 on flint 21 strikes the frizzen surface 39 a glancing blow so that the flint, because of its great hardness, abrades a few iron particles from the surface 39 under a condition where they become incandescent. The motion of the flint against the frizzen causes the frizzen to move upward and away in a clockwise direction, shown in FIG. 1, so that the cover moves up as the frizzen moves back and exposes the recess 27. The sparks produced by the engagement of the flint and the frizzen surface fall onto the priming charge within the recess 27 to ignite the charge and cause the gun to discharge.

While the foregoing conventional flintlock arrangement is generally reliable under ideal conditions and use of the proper material for the flint 21, reliability of operation is greatly decreased if the edge 23 of flint 21 is not properly formed, or if a foreign substance, such as oil or water, is present on the frizzen surface 39 which may function to provide a lubricating action which prevents the flint from abrading the small particles of iron from the frizzen surface that are necessary for proper ignition of the priming charge.

The present invention provides a much improved ignition arrangement without changing the basic structure of the flintlock action. This is accomplished by the use of a Misch metal element mounted on the frizzen so that the flint operates to abrade small particles of the Misch metal as the hammer falls and the flint moves along the frizzen surface. Misch metal is a pyrophoric alloy which, when particles are abraded of sufficiently small size, will automatically ignite and incandesce at a high temperature as the particles move from the frizzen down into the pan recess 27 to provide an ideal ignition for the priming charge. Misch metal is widely known as it is used in "flint" in cigarette lighters and the like where the particles are abraded by a serrated wheel and used to ignite either a flammable liquid on a wick or a gas. Misch metal is an alloy of several rare earth metals, predominantly cerium, together with a certain amount of iron. A typical Misch metal composition used for lighter flints consists of a mixture of 50% cerium, 25% lanthanum, 18% neodymium, 5% praseodymium, and 2% of other rare earth elements, which is mixed in a 70% rare earth/30% iron alloy. While this material is generally formed into small cylinders for use with cigarette lighters, it is also commercially available in ⅛ inch square rods, and it is contemplated that the material in that form is the most desirable arrangement, since it produces, on the flat sides, an ideal striking surface.

Figure 2:
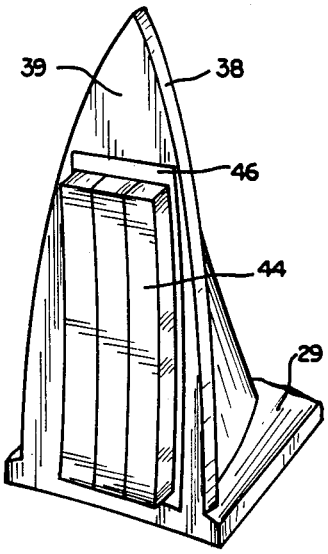
FIG. 2 is an enlarged, fragmentary, perspective view of the frizzen of the lock of FIG. 1, showing the preferred embodiment of the present invention mounted thereon.

According to the preferred embodiment of this invention, three strips of such Misch metal alloy are mounted on the backing of a plastic sheet having pressure-sensitive adhesive on the opposite side. The Misch metal can be caused to adhere to the sheet by the use of common adhesives such as cyanlacrylate adhesive and the plastic sheet may be of a heavy back pressure-sensitive tape. Thus, as shown in FIG. 2, three Misch metal rods 44 in parallel abutting relationships are secured on a backing sheet 46, and are formed with the curvature of the frizzen surface 39. Thus, all that is necessary to attach the Misch metal to the frizzen surface is to remove the release sheet from the pressure-sensitive surface and press the element in place on the frizzen surface. On the other hand, if a more permanent attachment is desired, rather than to use pressure-sensitive adhesives, to the aforesaid cyanoacylate adhesives may be used to fasten the sheet to the frizzen. However, such an arrangement is more difficult to remove than the arrangement using a pressure-sensitive adhesive, which allows easy removal of the element to restore the original function of the frizzen surface 39.

Generally, it has been found that the surface 23 of the flint 21 should not be a sharp edge, although such an edge will be found to function in an efficient manner. However, because of the softness of the Misch metal, there is a tendency for a sharp edge to gouge excessive large pieces of Misch metal from the strips 44, and such large pieces may not provide as reliable ignition as a larger number of small fragments. Furthermore, if the flint edge 23 bites too deeply into the Misch metal, it may prevent the frizzen and pan from rotating backward to fully expose the priming charge.

Figure 3:
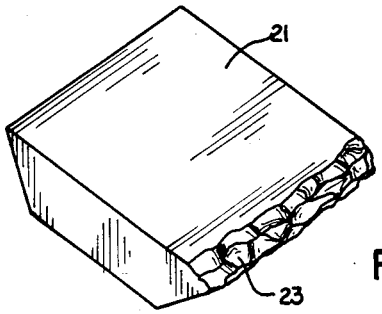
FIG. 3 is an enlarged, fragmentary, perspective view of a flint showing a preferred configuration of the striking surface.

Accordingly, a desirable edge 23 for the flint 21 is shown in FIG. 3, where the flint has been knapped in such a manner as to produce a large number of small, sharp edges producing a vertical face, in effect, on the flint. When this type of surface strikes the Misch metal strips, the result is the abrasion of a larger number of smaller pieces which gives more reliable ignition and much longer life to the Misch metal material. Furthermore, the position of the flint 21 between the jaws 16 and 17 can be varied to cause a strike at different vertical locations on the strips 44, to ensure more uniform wear and longer life for the pyrophoric metal element. Additionally, the flint 21 need not be of the conventional type for striking a steel frizzen, and other materials may be used. For example, the flint 21 could be replaced by a piece of hardened steel having a serrated face constructed in the manner of a conventional metal-working file. The only requirement for the striking surface 23 is that it have a large number of sharp edges for engaging the Misch metal, and that the serrations be open enough to prevent clogging by oxidized Misch metal, as would occur after a repeated number of firings. Thus, the term "flint" as used in this specification and in the claims is intended to include non-flint materials which can be clamped between the jaws 16 and 17 and used to abrade particles of the pyrophoric alloy.

Figure 4:
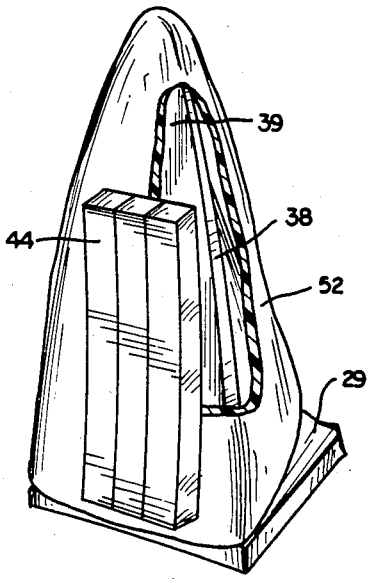
FIG. 4 is an enlarged, fragmentary, perspective view, with parts broken away, similar to FIG. 2, and showing another embodiment of the present invention.

Another embodiment of the invention is shown in FIG. 4 which allows more rapid mounting and removal of the pyrophoric alloy element. A resilient elastic, tube-like member 52 may be formed to be fitted over the projecting frizzen 38 to have a configuration conformable with that of the frizzen, and requiring sufficient elastic expansion so as to cause the sleeve to tightly grip the frizzen and be retained in place. The Misch metal strips 44 may then also be attached to the portion of the sleeve 52 overlying the frizzen surface 39 by a suitable adhesive, as discussed above. With such an arrangement, it is only necessary to slide the sleeve over the frizzen, and the strips 48 will be in place to be struck by the flint when it is desired to fire the mechanism. Likewise, the element may be removed by simple removal by sliding the sleeve off the frizzen.

Although several embodiments of the invention have been shown and described, it is recognized that other modifications and rearrangements may be resorted to without departing from the scope of the invention as defined by the following claims.

What is claimed is:

1. In a flintlock firearm having a lockplate, a hammer pivotally mounted on said lockplate, a flint carried on said hammer, a pan adapted to receive a priming charge and a frizzen constructed and positioned to be struck a blow by said flint on firing, the improvement comprising a pyrophoric element mounted on said frizzen and engageable by said flint on firing, whereby said flint abrades particles from said element and drives them into said pan.

2. A flintlock firearm as set forth in claim 1, wherein said pyrophoric element comprises at least one rod member secured to said frizzen.

3. A flintlock firearm as set forth in claim 2, wherein said rod member extends vertically along the face of said frizzen.

4. A flintlock firearm as set forth in claim 2, wherein said rod member is secured to a backing sheet secured to said frizzen.

5. A flintlock firearm as set forth in claim 4, wherein said backing sheet is secured to said frizzen by a pressure-sensitive adhesive.

6. A flintlock firearm as set forth in claim 5, wherein said pyrophoric element comprises a plurality of parallel rod members.

7. A flintlock firearm as set forth in claim 2, wherein said rod member is secured to an elastic sleeve surrounding said frizzen.

8. A flintlock mechanism comprising a lockplate, a pan mounted on said lockplate to hold a priming charge, a frizzen and pan cover pivotally mounted above said pan, a hammer pivotally mounted on said lockplate, a flint mounted on said hammer, said frizzen having a surface normally engageable by said flint when said hammer rotates toward said pan, and a pyrophoric element mounted on said frizzen surface and engageable by said flint, whereby said flint abrades particles from said pyrophoric element and drives said particles into said pan to ignite said priming charge.

9. A flintlock mechanism as set forth in claim 8, wherein said pyrophoric element is mounted on a backing sheet secured to said frizzen surface.

10. A flintlock mechanism as set forth in claim 9, wherein said sheet is secured to said frizzen surface by a pressure-sensitive adhesive.

11. A flintlock mechanism as set forth in claim 8, wherein said pyrophoric element is secured to an elastic sleeve surrounding said frizzen.

* * * * *